US005454559A

United States Patent [19]

Murakami et al.

[11] Patent Number: 5,454,559

[45] Date of Patent: Oct. 3, 1995

[54] RUBBER MEMBER FOR PAPER FEED DEVICE

[75] Inventors: Hirotoshi Murakami; Hitoshi Itani; Hiroaki Tanaka, all of Kobe, Japan

[73] Assignee: Sumio Gomu Kogyo Kabushiki Kaisha, Hyogo, Japan

[21] Appl. No.: 9,401

[22] Filed: Jan. 27, 1993

Related U.S. Application Data

[63] Continuation of Ser. No. 817,352, Jan. 6, 1992, abandoned.

[30] Foreign Application Priority Data

Jan. 7, 1991 [JP] Japan ..... 3-011474

[51] Int. Cl.[6] ..... B65H 3/52

[52] U.S. Cl. ..... 271/272; 271/264; 355/308; 355/309; 492/59; 428/36.8; 428/36.9; 524/433; 524/514; 524/186

[58] Field of Search ..... 524/433, 514, 524/186; 355/309, 308; 271/264, 272; 492/59; 428/36.8, 36.9

[56] References Cited

U.S. PATENT DOCUMENTS

| | | | |
|---|---|---|---|
| 4,272,179 | 6/1981 | Seanor | 492/59 |
| 4,373,239 | 2/1983 | Henry et al. | 492/53 |
| 4,568,625 | 2/1986 | Uchiyama et al. | 430/122 |
| 4,616,917 | 10/1986 | Sakurai | 219/216 |
| 4,626,568 | 12/1986 | Sato et al. | 524/433 |
| 4,967,231 | 10/1989 | Hosoya et al. | 355/219 |
| 5,049,610 | 9/1991 | Takaki et al. | 524/514 |

FOREIGN PATENT DOCUMENTS 0035975 of 0000 European Pat. Off. .

OTHER PUBLICATIONS

Patent Abstracts of Japan, vol. 10, No. 142 (M–481) (2199) 24 May 1986 & JP–A–60 262 748 (Sumitomo Gomu Kogyo KK,) Dec. 26, 1985.

Patent Abstracts of Japan, vol. 14, No. 286 (P–1064) Jun. 20 1990 & JP–A–2 084 664 (Sharp Corp.) Mar. 26, 1990 & World Patents Index Latest Derwent Publications Ltd., London, GB; AN DW 9018.

*Primary Examiner*—Paul R. Michl
*Assistant Examiner*—Andrew E. C. Merriam
*Attorney, Agent, or Firm*—Pollock, Vande Sande & Priddy

[57] ABSTRACT

An apparatus feed paper sheets to a photosensitive dram of an electronic copier, negatively charged toner adhering the dram. The apparatus incorporates a paper feed roller and a rubber member located adjacent the roller for supporting paper sheets in contacting relation to the roller. The robber member has a polymer, vulcanizer, vulcanization aid and filler; and at least one component selected from the group consisting of magnesium oxide, barium oxide, nylon short fibers, powder of nylon short fibers and nigrosine compound. The component is present in an amount of 1 to 100 parts by weight to 100 parts by weight of the polymer. The paper sheet becomes electrostatically charged negatively, when contacting the rubber member during sheet feeding by the roller, thus preventing electrostatic attraction between the paper approaching the dram and negatively charged toner on the dram.

6 Claims, 2 Drawing Sheets

RUBBER MEMBER FOR PAPER FEED DEVICE

This application is a continuation of Ser. No. 07/817,352 filed on Jan. 6, 1992, now abandoned.

BACKGROUND OF THE INVENTION

1. Field of the Invention

The present invention relates to a rubber member for a paper feed device, more particularly to a rubber member which is outstandingly effective when used as a duplicate feed preventive rubber pad or rubber roller for separating and feeding sheets of paper smoothly, one by one in a paper feed device of copier, facsimile apparatus, printer or other office automating equipment.

2. Prior Art

In a paper feed device for a copier, facsimile apparatus, printer or other office automating equipment, in order to feed multiple sheets of paper set up in a stack-up state in a cassette or the like by separating one by one, the roller/pad separating method as shown in FIG. 1, the roller/roller separating method as shown in FIG. 2 or other separating mechanism is provided. In FIG. 1 and FIG. 2, numerals 1, 2 and 3 respectively, denote sheets of paper, a paper feed roller, and a rubber pad or rubber roller as duplicate feed preventive rubber member.

Using the paper feed rubber roller 2 and duplicate feed preventive rubber member 3, in order to feed multiple sheets of paper 1, 1 . . . set in a stack-up state in a cassette (not shown) or the like smoothly by separating one by one, it is required that the friction coefficient between members should satisfy the following formula 1.

$$\mu F > \mu R > \mu P \qquad \text{Formula 1}$$

where μF is the friction coefficient between feed roller 2 and paper 1, μR is the friction coefficient between duplicate feed preventive rubber member 3 and paper 1, and μP is the friction coefficient between sheets of paper 1, 1.

This relation must be maintained even after passing at least 100,000 sheets.

As a result of measurement of μF and μP in actually used members, μF was 1.5 to 2.5 and μF was 0.3 to 0.6, and hence μR is desired to be somewhere between 0.7 and 1.2. In the case of a film for an OHP (overhead projector), μF is 2.5 to 3.0 and μP is 0.3 to 1.5, and hence μR should be 1.7 to 2.4.

Hitherto, the duplicate feed preventive rubber member 3 is composed of, as a substance excellent in wear resistance, urethane, combination of urethane and cork, natural rubber, chloroprene, or the like.

In the conventional duplicate feed preventive rubber member 3 composed of urethane, combination of urethane and cork, natural rubber, chloroprene or the like, when sliding on the paper 1, the paper 1 is electrically charged, and an electrostatic image disturbance occurs in the transfer step in the electrophotographic process. In the electrophotographic progress, generally, for example in the electrophotographic apparatus as shown in FIG. 3, after the surface of a photosensitive drum 4 is uniformly charged by a charger 5, an optical image of the original is projected. The electric charge disappears in the illuminated portion, thereby forming an electrostatic latent image (an invisible electric image) on the surface of this photosensitive drum 4, and a toner (the developer) is pulled out from a toner tank of a developing roller 6 to deposit on the charged portion of the surface of the photosensitive drum 4. The toner on the surface of the photosensitive drum 4 is transferred on the paper 1, electrically charged by a transfer charger 7, then the toner image transferred on the paper 1 is passed through two rollers (not shown) to be fixed thermally (about 160° to 200° C.). On the other hand, generally, when the paper 1 onto rubber member 3 slide on each other, the paper 1 is positively charged, while the rubber member 3 is negatively charged. In this mechanism of electrophotographic apparatus, when using a toner of negative electric charge, if the paper 1 is positively charged, it may attract the toner of negative charge on the surface of the photosensitive drum 4 before transfer as shown in FIG. 4, which may result in image disturbance.

It may be therefore considered to make the rubber compositive conductive so as not to charge by blending the polymer with carbon black or conductive zinc white, but if the carbon black is blended sufficiently so as to be conductive, when sliding on the paper 1, the paper 1 may be stained, and it is not suited as the duplicate feed preventive rubber member 2. Or if the conductive zinc white is blended enough to be conductive, the wear resistance is impaired, and it is not suited as the duplicate feed preventive rubber member used in severe abrasive condition of sliding against the paper 1.

SUMMARY OF THE INVENTION

The present inventors intensively investigated and studied in order to solve the above problems of the prior art and reached the invention by discovering that it would be better to consider a method to charge the paper electrostatically, instead of preventing electric charge of paper by making the duplicate feed preventive rubber member conductive. That is, the invention is characterized by the rubber member which is composed in such a blend as to be charged positively when sliding on the paper.

By using the rubber member of the invention, when sliding on the paper, it is positively charged, and the paper is negatively charged which repels against the toner of negative charge before the transfer step, and therefore the toner is not attracted to the paper, so that image disturbance does not occur.

DETAILED DESCRIPTION OF THE PREFERRED EMBODIMENTS

Figure 1:
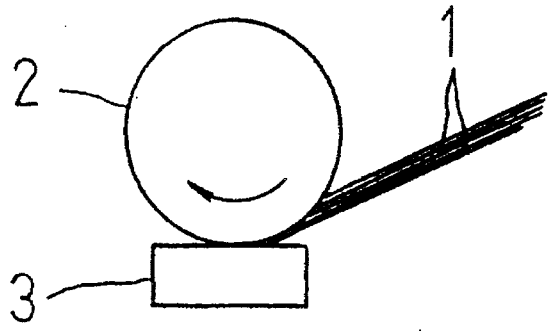
FIG. 1 is an explanatory diagram showing the paper separating mechanism of a roller/pad separating system.
Figure 2:
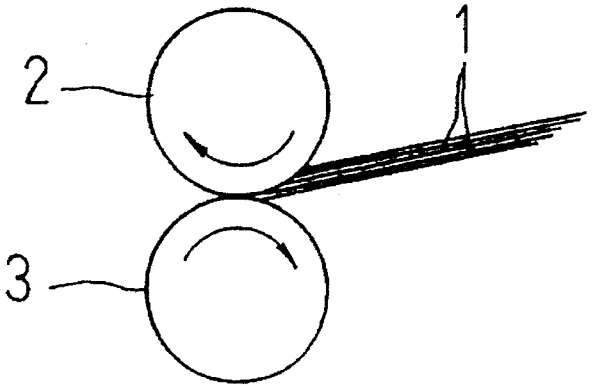
FIG. 2 is an explanatory diagram showing the paper separating mechanism of a roller/roller separating system.
Figure 3:
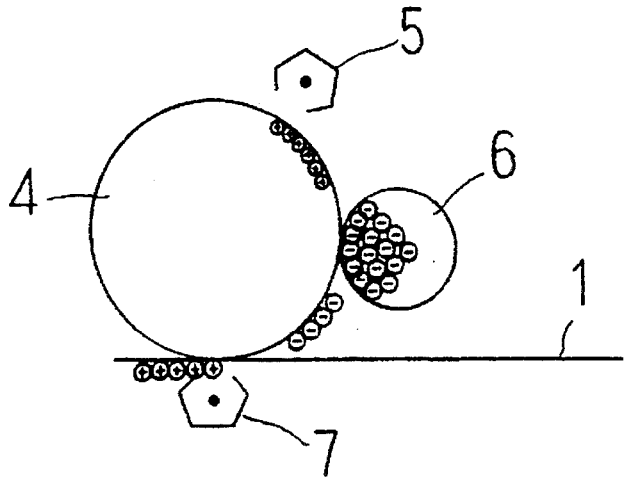
FIG. 3 is an explanatory diagram showing the peripheral parts of the photosensitive unit of an electronic copier.
Figure 4:
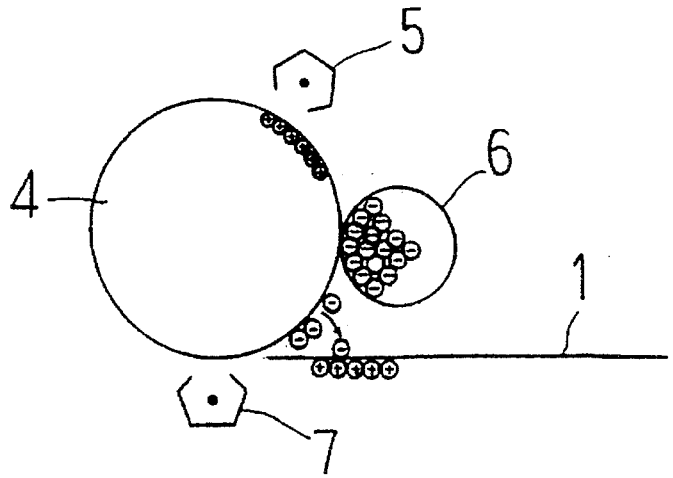
FIG. 4 is an explanatory diagram showing the image disturbance occurring when the paper is positively charged.

Some of the embodiments of the rubber member for the paper feed device of the invention are described in detail below.

In a first embodiment of the rubber member of the invention, it is composed of a blend of a polymer containing proper amounts of ordinary vulcanizer, vulcanization aid, and filler [for example, NBR (acrylonitrile-butadiene copolymer rubber), NR (natural rubber), urethane, etc.] with magnesium oxide or barium oxide, and this blend is formed in a desired shape by crosslinking through the process of transfer forming, injection forming, press forming or extrusion forming.

Since this rubber member contains magnesium oxide or barium oxide, it decreases the quantity of negative electric charge applied when sliding on the paper, and is positively charged to the contrary. As a result, the paper is negatively charged, and it repels against the toner of negative charge, and therefore the toner will not be attracted to the paper before the transfer step. Here, in order to be charged positively when sliding onto the paper, a proper content of the magnesium oxide or barium oxide should be 1 to 100 parts by weight to 100 parts by weight of the polymer.

In a second embodiment of the invention, the rubber member is composed of a blend of the same polymer as in the first embodiment with nylon short fiber or its powder, and this blend is crosslinked and formed. By sliding onto the paper, it was also positively charged, and the paper was negatively charged, as confirmed in the experiment by the applicant. In order to be charged positively when sliding onto the paper, a proper content of the nylon short fiber or its powder should be 1 to 100 parts by weight to 100 parts by weight of the polymer.

In a third embodiment of the invention, it is composed of a blend of the same polymer as in the first embodiment with nigrosines compound (made by Orient Chemical Industrial Co.). This blend is crosslinked and formed, and by sliding onto the paper, it was also positively charged and the paper was negatively charged, as confirmed in the experiment by the applicant. In order to be charged positively when sliding onto the paper, a proper content of the nigrosine compound should be 1 to 100 parts by weight to 100 parts by weight of the polymer.

The attached Table 1 shows the results of an experiment conducted to prove positive electric charging of the rubber member blending magnesium oxide or barium oxide, nylon short fiber or its powder, and nigrosine compound, when sliding onto the paper. However, in test (A) the above substances were not blended in the NBR, in tests (B), (C) the NBR was blended with nylon short fiber or its powder, in test (D) the above substances were not blended in the NR, in tests (E), (F) magnesium oxide or barium oxide was mixed in the NR, in test (C) the above substances were not blended in the urethane, and in test (H) the urethane was blended with nigrosine compound.

As is clear from the results of an experiment in Table 1, it is known that the materials were positively charged when sliding on the paper in tests (B), (C), (E), (F), (H). It is hence evident that when blended with magnesium oxide or barium oxide, nylon short fiber or its powder, or nigrosine compound, the paper is negatively charged and the toner is not attracted before the transfer step.

Meanwhile, the foregoing embodiments are about the rubber member blending magnesium oxide or barium oxide, nylon short fiber or its powder, and nigrosine compound, but the invention is not limited to these embodiments alone; any other substance to be charged positively when sliding on the paper may be blended, and two or more substances may be also blended.

The above embodiments relate to the duplicate feed preventive rubber member for a paper feed device used in office automating equipment, but the invention is not limited to this, and may be applied to any rubber member sliding on the paper.

According to the invention as described herein, it is possible to present a rubber member capable of controlling the electric charging of the paper when sliding onto the paper and preventing electrostatic image disturbance in the transfer step during the electrophotographic process.

What is claimed is:

1. A paper charging apparatus comprising:

a paper feed roller;

a rubber pad located adjacent the roller for supporting paper sheets, free of toner;

the roller and pad frictionally rolling the sheets in a predetermined direction;

the pad having a polymer, vulcanizer, vulcanization aid and filler; and at least one component selected from the group consisting of magnesium oxide, barium oxide, nylon short fibers, powder of nylon short fibers and nigrosine compound, wherein said component is present in an amount of 1 to 100 parts by weight to 100 parts by weight of the polymer;

each paper sheet being electrostatically charged negatively, when contacting the rubber pad, the rubber pad being positively charged when contacting paper sheets;

a photosensitive drum located downstream of the roller and the pad; and toner adhering to the drum and negatively charged to prevent electrostatic attraction of the toner by approaching sections of negatively charged paper sheets.

2. A paper charging apparatus comprising:

a paper feed roller;

a rubber roller located adjacent the roller for supporting paper sheets, free of toner;

the paper feed and rubber rollers frictionally rolling the sheets in a predetermined direction;

the rubber roller having a polymer, vulcanizer, vulcanization aid and filler; and at least one component selected from the group consisting of magnesium oxide, barium oxide, nylon short fibers, powder of nylon short fibers and nigrosine compound, wherein said component is present in an amount of 1 to 100 parts by weight to 100 parts by weight of the polymer;

each paper sheet being electrostatically charged negatively, when contacting the rubber roller, the rubber roller being positively charged when contacting paper sheets.

a photosensitive drum located downstream of the roller and the pad; and toner adhering to the drum and negatively charged to prevent electrostatic attraction of the toner by approaching sections of negatively charged paper sheets.

3. The charging apparatus set forth in claim 1 further comprising rollers, located downstream of the photosensitive drum, for frictionally engaging the toner laden sheets and thermally fixing the toner thereon.

4. The charging apparatus set forth in claim 2 further comprising rollers, located downstream of the photosensitive drum, for frictionally engaging the toner laden sheets and thermally fixing the toner thereon.

5. The apparatus of claim 1 wherein said polymer is selected from the group consisting of acrylonitrile-butadiene copolymer robber (NBR), natural robber (NR), and urethane.

6. The apparatus of claim 2 wherein said polymer is selected from the group consisting of acrylonitrile-butadiene copolymer rubber (NBR), natural rubber (NR), and urethane.

* * * * *